US009915905B2

(12) United States Patent
Morimoto et al.

(10) Patent No.: US 9,915,905 B2
(45) Date of Patent: Mar. 13, 2018

(54) IMAGE FORMING APPARATUS

(71) Applicant: Konica Minolta, Inc., Tokyo (JP)

(72) Inventors: Hiroshi Morimoto, Akiruno (JP); Wataru Watanabe, Hachioji (JP); Shunichi Takaya, Hino (JP); Kei Okamura, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/172,238

(22) Filed: Jun. 3, 2016

(65) Prior Publication Data

US 2016/0378038 A1 Dec. 29, 2016

(30) Foreign Application Priority Data

Jun. 25, 2015 (JP) ..... 2015-127489

(51) Int. Cl.
*G03G 15/00* (2006.01)

(52) U.S. Cl.
CPC ..... *G03G 15/556* (2013.01); *G03G 15/5058* (2013.01); *G03G 2215/00029* (2013.01)

(58) Field of Classification Search
CPC ..... G03G 15/556; G03G 15/5058; G03G 2215/00029
See application file for complete search history.

(56) References Cited

U.S. PATENT DOCUMENTS 8,849,134 B2 * 9/2014 Ogawa ..... G03G 15/5058 399/49
2012/0099165 A1 * 4/2012 Omori ..... G03G 15/5058 358/475
2013/0243456 A1 * 9/2013 Kaneko ..... G03G 15/5037 399/48
2014/0268242 A1 * 9/2014 Kaneko ..... G03G 15/5058 358/3.06
2014/0270827 A1 * 9/2014 Muto ..... G03G 15/5058 399/49

(Continued)

FOREIGN PATENT DOCUMENTS

JP 2007140402 A 6/2007
JP 2011170156 A 9/2011

*Primary Examiner* — Ryan Walsh
(74) *Attorney, Agent, or Firm* — Lucas & Mercanti, LLP

(57) ABSTRACT

An image forming apparatus includes: an image forming unit including a rotating member; a rotation position detecting unit that detects a rotation position of the rotating member; an image density detecting unit that detects density of an image; an image information analysis unit that analyzes image information; a density profile management unit that manages a density profile; a correction data generation unit that generates correction data; a density correction unit that performs density correction; and a density correction control unit that sets a density correction level, wherein when the density correction level is set at reference accuracy, the density correction unit corrects density, and when the density correction level is set at accuracy higher than the reference accuracy, the density profile management unit forms a corrective patch image and generates a new density profile, the correction data generation unit updates the correction data, and the density correction unit corrects density.

10 Claims, 4 Drawing Sheets

(56) References Cited

U.S. PATENT DOCUMENTS

| | | | | |
|---|---|---|---|---|
| 2014/0301748 | A1* | 10/2014 | Suzuki | G03G 15/5025 399/49 |
| 2015/0362879 | A1* | 12/2015 | Kaneko | G03G 15/556 399/49 |
| 2016/0150117 | A1* | 5/2016 | Furuta | G03G 15/5058 399/45 |
| 2016/0334734 | A1* | 11/2016 | Kaneko | G03G 15/065 |
| 2016/0378035 | A1* | 12/2016 | Okamura | G03G 15/5058 399/72 |

* cited by examiner

IMAGE FORMING APPARATUS

The entire disclosure of Japanese Patent Application No. 2015-127489 filed on Jun. 25, 2015 including description, claims, drawings, and abstract are incorporated herein by reference in its entirety.

BACKGROUND OF THE INVENTION

Field of the Invention

The present invention relates to an electrophotographic image forming apparatus, and particularly to a technique which eliminates a periodic density variation occurring in a subscanning direction.

Description of the Related Art

Generally, in an image forming apparatus (such as a printer, a copying machine, and a facsimile) using an electrophotographic process technique, a uniformly charged photoconductor (for example, a photoconductor drum) is irradiated with (exposed to) light based on input image data, and thereby an electrostatic latent image is formed on a surface of the photoconductor. By supplying toner to the photoconductor on which the electrostatic latent image has been formed, the electrostatic latent image is visualized to form a toner image. The toner image is transferred to a sheet directly or indirectly through an intermediate transfer member, and subsequently heated and pressurized at a fixing unit, whereby an image is formed on the sheet.

An image forming apparatus includes, as a constituent for image formation, various rotating members such as a photoconductor and a developer holding member. It has been known that a periodic density variation is caused in an image in a subscanning direction thereof by rotation runout of these rotating members. For example, since a gap (development gap) between a photoconductor and a developer holding member is periodically varied based on rotation runout of the photoconductor or the developer holding member, an electric field intensity is periodically varied even if a constant developing bias is applied. As a result, a density variation occurs in an image with the same period as a rotation period of the photoconductor or the developer holding member. Hereinbelow, a periodic density variation occurring in an image in a subscanning direction thereof is referred to as "periodic density unevenness".

In a conventional image forming apparatus, in order to offset periodic density unevenness, correction data is generated which is corresponding to rotational positions (phases obtained by using a home position as a reference) of a photoconductor, based on, for example, a density profile indicating periodic density unevenness. With this correction data, followings are corrected: image forming conditions such as exposure energy (exposure time or exposure output), a charge voltage, a developing bias voltage, rotations of a developer holding member (for example, a developing roller), and a density value (gradation value) of input image data (for example, JP 2007-140402 A).

The density profile is generated, for example, by forming a density-corrective patch image (such as a halftone image with halftone density) on a toner image holding member such as an intermediate transfer belt, and detecting the image density of the corrective patch image. At that time, the corrective patch image is formed such that a length in a subscanning direction thereof is adjusted to be longer than the longest period length (generally, period length of a photoconductor) of period lengths (length corresponding to a rotation period) of rotating members by which periodic density unevenness occurs. The corrective patch image is formed to be longer than a plurality of period lengths of a rotating member, and results of the image density detection are averaged. By doing so, a highly accurate density profile can be obtained.

In order to improve the accuracy of density correction, it is preferable to update the density profile periodically or at a predetermined timing such as when starting a print job. The reason being that the density profile varies in accordance with variations in developability and transferability caused by an environmental and temporal influence.

In JP 2011-170156 A, it is disclosed that in an image forming apparatus, a relationship between a development gap and writing sensitivity is grasped in advance, and image forming conditions such as an exposure amount are corrected according to a rotation position of a rotating member.

However, in a case where the length of the corrective patch image in the subscanning direction thereof is increased, or where the density profile is frequently updated, although the accuracy of density correction is improved, the following problems occur: a load on a cleaning unit is increased when removing the corrective patch image formed on the toner image holding member; consumption of toner required for density correction is increased; and a longer period of time is required for density correction, which results in a decrease in productivity.

In addition, the technique described in JP 2011-170156 A cannot be appropriately applied to a case where the periodicity of a development gap has varied, and there may be a case where image quality is decreased by correcting image forming conditions.

SUMMARY OF THE INVENTION

An object of the present invention is to provide an image forming apparatus capable of efficiently correcting periodic density unevenness.

To achieve the abovementioned object, according to an aspect, an image forming apparatus reflecting one aspect of the present invention comprises: an image forming unit that includes a rotating member as a constituent, and forms an image on a sheet based on print job data; a rotation position detecting unit that detects a rotation position of the rotating member; an image density detecting unit that detects density of an image formed on an image holding member by the image forming unit; an image information analysis unit that analyzes image information included in the print job data; a density profile management unit that manages a density profile indicating density variations in a subscanning direction in such a way that a phase of the density profile corresponds to a rotation position of the rotating member; a correction data generation unit that generates correction data corresponding to a rotation position of the rotating member based on the density profile; a density correction unit that performs density correction with the correction data; and a density correction control unit that sets a density correction level based on image information of an image to be formed, wherein when the density correction level is set at reference accuracy, the density correction unit performs density correction using existing correction data, and when the density correction level is set at accuracy higher than the reference accuracy, the density profile management unit forms, on the image holding member, a corrective patch image longer than a period length of the rotating member, and generates a new density profile based on a detection result of the image density detecting unit regarding the corrective patch image, the correction data generation unit updates the correction data based on the new density profile, and the density correction unit performs density correction using the updated correction data.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the drawings. However, the scope of the invention is not limited to the illustrated examples.

Figure 1:
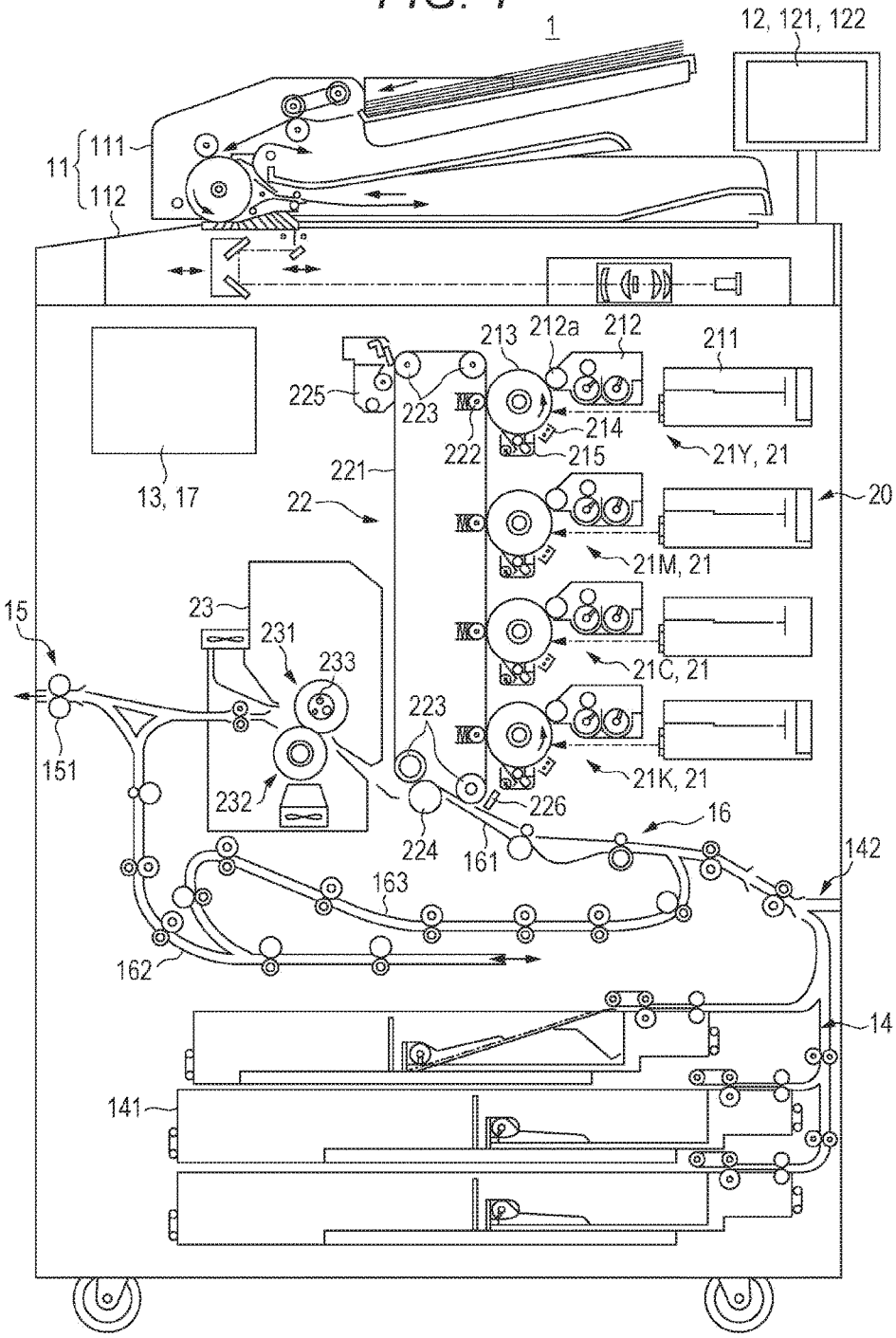
FIG. 1 is a view illustrating an overall configuration of an image forming apparatus.
Figure 2:
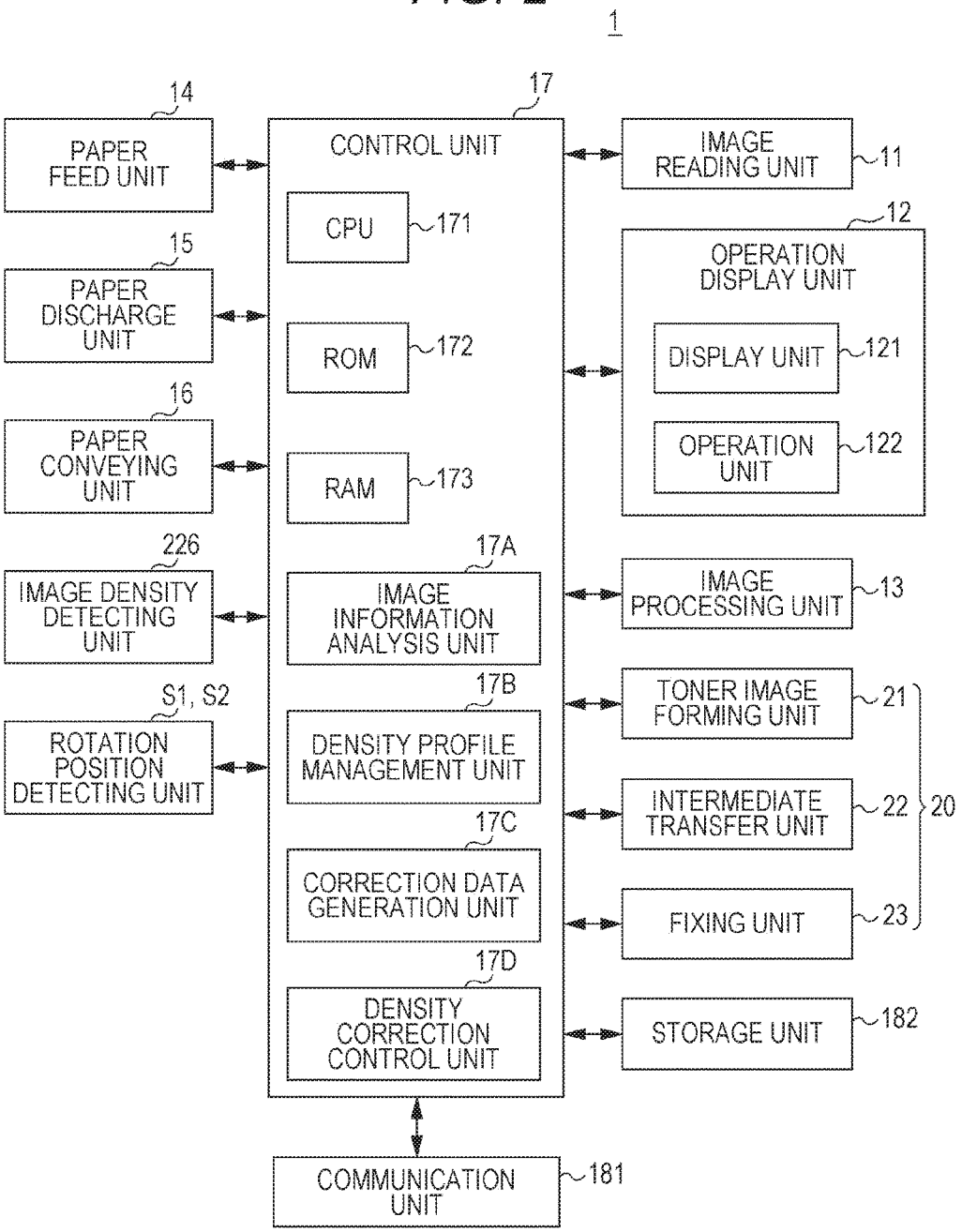
FIG. 2 is a diagram illustrating major parts of a control system of the image forming apparatus.

FIG. 1 is a view illustrating an overall configuration of an image forming apparatus 1. FIG. 2 is a diagram illustrating major parts of a control system of the image forming apparatus 1.

The image forming apparatus 1 illustrated in FIGS. 1 and 2 is an intermediate transfer-type color image forming apparatus using an electrophotographic process technique. In the image forming apparatus 1, a vertical tandem system is employed in which photoconductor drums 213 corresponding to four colors of C, M, Y, and K are arranged in tandem in a travelling direction (vertical direction) of an intermediate transfer belt 221, and toner images of respective colors are sequentially transferred to the intermediate transfer belt 221 in one procedure.

In other words, the image forming apparatus 1 forms an image by primarily transferring the toner images of respective colors of yellow (Y), magenta (M), cyan (C), and black (K), formed on the photoconductor drums 213, to the intermediate transfer belt 221, superimposing the toner images of four colors on the intermediate transfer belt 221, and secondarily transferring the superimposed image to a sheet.

As illustrated in FIGS. 1 and 2, the image forming apparatus 1 includes an image reading unit 11, an operation display unit 12, an image processing unit 13, an image forming unit 20, a paper feed unit 14, a paper discharge unit 15, a paper conveying unit 16, and a control unit 17.

The control unit 17 includes a central processing unit (CPU) 171, a read only memory (ROM) 172, and a random access memory (RAM) 173. The CPU 171 reads, from the ROM 172 or a storage unit 182, a program appropriate for processing, develops the program on the RAM 173, and performs centralized control of operations of respective blocks of the image forming apparatus 1 in cooperation with the developed program.

The control unit 17 transmits and receives various data with an external apparatus (for example, as a personal computer) connected to a communication network such as a local area network (LAN) and a wide area network (WAN), through a communication unit 181. For example, the control unit 17 receives print job data transmitted from the external apparatus, and generates input image data based on the print job data. The print job data is described with a predetermined page description language (PDL), and includes, for example, data of an image object such as graphics and photographs, and data of a text object such as characters and symbols.

In addition, the control unit 17 functions as an image information analysis unit 17A, a density profile management unit 17B, a correction data generation unit 17C, and a density correction control unit 17D.

The communication unit 181 includes various interfaces such as a network interface card (NIC), a modulator-demodulator (MODEM), and a universal serial bus (USB), thereby making it possible to perform information communication with external apparatuses.

The storage unit 182 includes, for example, a non-volatile semiconductor memory (so-called flash memory) or a hard disk drive. The storage unit 182 stores, for example, a lookup table to be referred to when operations of respective blocks are controlled.

The image reading unit 11 includes an auto document feeder (ADF) 111 and a document image scanner 112.

The auto document feeder 111 conveys a document placed on a document tray by a conveying mechanism to the document image scanner 112. With the auto document feeder 111, it is possible to successively read images on (either one or both sides of) many documents placed on the document tray.

The document image scanner 112 optically scans a document conveyed onto a contact glass from the auto document feeder 111, or a document placed on the contact glass, images light reflected from the document on a light receiving plane of a charge coupled device (CCD) sensor, and reads a document image. The image reading unit 11 generates input image data based on a result of reading by the document image scanner 112. The input image data is subjected to predetermined image processing in the image processing unit 13.

The operation display unit 12 includes, for example, a liquid crystal display (LCD) with a touch panel, and functions as a display unit 121 and an operation unit 122.

In accordance with a display control signal input from the control unit 17, the display unit 121 displays, for example, various operation screens, a state of an image, and an operation status of each function.

The operation unit 122 includes various operation keys such as ten keys and a start key, accepts various input operations from a user, and outputs an operation signal to the control unit 17. The user can operate the operation display unit 12 to perform a setting for image formation such as a document setting, an image quality setting, a magnification setting, an application setting, an output setting, and a paper setting.

The image processing unit 13 includes a circuit which performs digital image processing to the input image data according to an initial setting or a user setting. For example, the image processing unit 13 corrects gradation based on gradation correction data under the control of the control unit 17. In addition, the image processing unit 13 performs various kinds of correction processing such as color correction and shading correction to the input image data. The image forming unit 20 is controlled based on image data which has been subjected to the above processing.

In addition, the image processing unit 13 functions as a density correction unit, and corrects density by using correction data generated by the correction data generation unit 17C. Specifically, the image processing unit 13 corrects an image forming condition such as exposure energy (exposure time or exposure output), a charge voltage, a developing bias voltage, rotations of a developer holding member 212*a*, or a density value (gradation value) of input image data.

The image forming unit 20 includes a toner image forming unit 21, an intermediate transfer unit 22, and a fixing unit 23. The toner image forming unit 21 forms toner images by color toners of Y, M, C, and K components, respectively, based on the input image data. The intermediate transfer unit 22 transfers the toner image formed by the toner image forming unit 21 to a sheet. The fixing unit 23 fixes the toner image transferred to the sheet.

The toner image forming unit 21 includes four toner image forming units 21Y, 21M, 21C, and 21K for Y, M, C, and K components, respectively. Since the toner image forming units 21Y, 21M, 21C, and 21K have the same configuration, for the convenience of illustration and description, common constituents are denoted by the same signs, and in a case where such components are individually denoted, Y, M, C, or K is attached to the signs thereof. In FIG. 1, signs are attached only to constituents of the toner image forming unit 21Y for the Y component, and regarding constituents of other toner image forming units 21M, 21C, and 21K, signs are omitted.

The toner image forming unit 21 includes an exposure apparatus 211, a developing apparatus 212, a photoconductor drum 213, a charging apparatus 214, and a drum cleaning apparatus 215. The toner image forming unit 21 may include an erasing apparatus which erases residual charge remaining on a surface of the photoconductor drum 213 after primary transfer.

The photoconductor drum 213 is a negative charge-type organic photoconductor (OPC) obtained by sequentially stacking an under coat layer (UCL), a charge generation layer (CGL), and a charge transport layer (CTL) on a circumferential surface of a conductive cylinder made of aluminum (aluminum stock pipe). The charge generation layer includes an organic semiconductor in which a charge generation material (for example, phthalocyanine pigment) is dispersed in a binder resin (for example, polycarbonate), and generates a pair of positive charge and negative charge upon exposure by the exposure apparatus 211. The charge transport layer includes a binder resin (for example, polycarbonate resin) having a hole transport material (electron-donating nitrogen-containing compound) dispersed therein, and transports positive charge generated in the charge generation layer to a surface of the charge transport layer.

A home position mark which indicates a reference position is provided in the photoconductor drum 213, and a sensor S1 (see FIG. 2, rotation position detecting unit) is disposed adjacent to the photoconductor drum 213. A rotation position of the photoconductor drum 213 is specified based on elapsed time after the home position mark has been detected by the sensor S1.

The charging apparatus 214 includes a corona discharge generator such as a scorotron charging apparatus or a corotron charging apparatus. The charging apparatus 214 negatively charges a surface of the photoconductor drum 213 uniformly by corona discharge.

The exposure apparatus 211 includes a light emitting diode (LED) array, an LPH driving unit (driver IC), and an LED print head. In the LED array, a plurality of LEDs is linearly arranged. The LPH driving unit (driver IC) drives individual LEDs. The LED print head includes a lens array which images light emitted from the LED array on the photoconductor drum 213. One LED in the LED array corresponds to one dot of an image.

The exposure apparatus 211 irradiates the photoconductor drum 213 with light corresponding to an image of each color component. By the irradiation with light, positive charge is generated in the charge generation layer of the photoconductor drum 213. The positive charge is transported to a surface of the charge transport layer, thereby neutralizing surface charge (negative charge) of the photoconductor drum 213. Consequently, an electrostatic latent image of each color component is formed by a potential difference from surroundings on the surface of the photoconductor drum 213.

The developing apparatus 212 accommodates a developer (for example, two-component developer including toner and a magnetic carrier) of each color component, and forms a toner image by attaching toner of each color component to the surface of the photoconductor drum 213 to visualize the electrostatic latent image. Specifically, a development bias voltage is applied to the developer holding member 212*a* (for example, developing roller), and an electric field is formed between the photoconductor drum 213 and the developer holding member 212*a*. By a potential difference between the photoconductor drum 213 and the developer holding member 212*a*, the charged toner on the developer holding member 212*a* is moved to an exposed portion on the surface of the photoconductor drum 213, and adhered thereto.

A home position mark which indicates a reference position is provided in the developer holding member 212*a*, and a sensor S2 (see FIG. 2, rotation position detecting unit) is disposed adjacent to the developer holding member 212*a*. A rotation position of the developer holding member 212*a* is specified based on elapsed time after the home position mark has been detected by the sensor S2.

The drum cleaning apparatus 215 includes a drum cleaning blade which slidingly contacts the surface of the photoconductor drum 213, and removes remaining toner which remains on the surface of the photoconductor drum 213 after the primary transfer.

The intermediate transfer unit 22 includes an intermediate transfer belt 221, a primary transfer roller 222, a plurality of support rollers 223, a secondary transfer roller 224, and a belt cleaning apparatus 225.

The intermediate transfer belt 221 includes an endless belt and is extended among the support rollers 223 like a loop. At least one of the support rollers 223 includes a drive roller, and others include a driven roller. With rotation of the drive roller, the intermediate transfer belt 221 travels at a constant speed.

The primary transfer roller 222 is disposed to be opposed to the photoconductor drum 213 of each color component, on the side of inner circumferential surface of the intermediate transfer belt 221. The primary transfer roller 222 is in pressure contact with the photoconductor drum 213 interposing the intermediate transfer belt 221 therebetween, thereby forming a primary transfer nip (hereinafter referred to as "primary transfer portion") for transferring a toner image to the intermediate transfer belt 221 from the photoconductor drum 213.

The secondary transfer roller 224 is disposed to be opposed to one of the support rollers 223, on the side of outer circumferential surface of the intermediate transfer belt 221. Among the support rollers 223, the support roller 223 disposed to be opposed to the intermediate transfer belt 221 is referred to as a backup roller. The secondary transfer roller 224 is in pressure contact with the backup roller interposing the intermediate transfer belt 221 therebetween, thereby forming a secondary transfer nip (hereinafter referred to as "secondary transfer portion") for transferring a toner image to a sheet from the intermediate transfer belt 221. Instead of the secondary transfer roller 224, a configuration (so-called a belt-type secondary transfer unit) may be employed in which a secondary transfer belt is extended like a loop among support rollers including a secondary transfer roller.

In the primary transfer portion, the toner image on the photoconductor drum 213 is primarily transferred to the intermediate transfer belt 221 in a sequentially superimposed manner. Specifically, a primary transfer bias is applied to the primary transfer roller 222, thereby imparting charge having a polarity opposite to that of the toner to the back surface side (a side in contact with the primary transfer roller 222) of the intermediate transfer belt 221. By doing so, the toner image is electrostatically transferred to the intermediate transfer belt 221.

Thereafter, while a sheet passes through the secondary transfer portion, the toner image on the intermediate transfer belt 221 is secondarily transferred to the sheet. Specifically, a secondary transfer bias is applied to the secondary transfer roller 224, thereby imparting charge having a polarity opposite to that of the toner to the back surface side (a side in contact with the secondary transfer roller 224) of the sheet. By doing so, the toner image is electrostatically transferred to the sheet. The sheet to which the toner image has been transferred is conveyed toward the fixing unit 23.

The belt cleaning apparatus 225 includes a belt cleaning blade which slidingly contacts the surface of the intermediate transfer belt 221, and removes remaining toner which remains on the surface of the intermediate transfer belt 221 after the secondary transfer. A corrective patch image formed on the intermediate transfer belt 221 when a density profile is generated is removed by the belt cleaning apparatus 225.

An image density detecting unit 226 is disposed in a region located on a downstream side of the primary transfer portion in a travelling direction of the belt, and an upstream side of the secondary transfer portion in a travelling direction of the belt. The image density detecting unit 226 detects density of the toner image formed on the intermediate transfer belt 221.

The image density detecting unit 226 includes a reflection-type optical sensor which includes a light emitting element such as a light emitting diode (LED) and a light receiving element such as a photodiode (PD), and detects a reflection intensity of the toner image. The image density detecting unit 226 is used when generating the density profile, and updating the density profile. The image density detecting unit 226 may be a line-type sensor.

The fixing unit 23 includes an upper fixing unit 231, a lower fixing unit 232, a heat source 233, and a pressing/separating unit (not illustrated). The upper fixing unit 231 includes a fixing surface side member disposed on a fixing surface (surface on which the toner image has been formed) side of the sheet. The lower fixing unit 232 includes a back surface-side support member disposed on a back surface (surface opposite to the fixing surface) side of the sheet. The heat source 233 heats the fixing surface side member. The pressing/separating unit presses the back surface-side support member against the fixing surface side member.

For example, when the upper fixing unit 231 is configured as a roller heating system, a fixing roller serves as a fixing surface side member, and when configured as a belt heating system, a fixing belt serves as a fixing surface side member. For example, when the lower fixing unit 232 is configured as a roller pressurizing system, a pressure roller serves as a back surface-side support member, and when configured as a belt pressurizing system, a pressure belt serves as a back surface-side support member. FIG. 1 illustrates a case where the upper fixing unit 231 is configured as a roller heating system, and the lower fixing unit 232 is configured as a roller pressurizing system.

The upper fixing unit 231 includes an upper fixing unit driving unit (not illustrated) for rotating the fixing surface side member. The control unit 17 controls an operation of the upper fixing unit driving unit, and thereby the fixing surface side member rotates (travels) at a predetermined speed. The lower fixing unit 232 includes a lower fixing unit driving unit (not illustrated) for rotating the back surface-side support member. The control unit 17 controls an operation of the lower fixing unit driving unit, and thereby the back surface-side support member rotates (travels) at a predetermined speed. In a case where the fixing surface side member follows the rotation of the back surface-side support member, there is no need to include the upper fixing unit driving unit.

The heat source 233 is disposed inside or in the vicinity of the fixing surface side member. Based on a detection result of a fixing temperature detecting unit (not illustrated) disposed adjacent to the fixing surface side member, the control unit 17 controls output of the heat source 233 such that a fixing temperature is adjusted to be a fixing control temperature. The control unit 17 controls output of the heat source 233, and thereby the fixing surface side member is heated and maintained at a fixing control temperature (for example, a fixing target temperature and an idling temperature).

The pressing/separating unit (not illustrated) presses the back surface-side support member against the fixing surface side member. The pressing/separating unit is in contact with both end portions of a shaft which supports the back surface-side support member, and presses both ends of the shaft independently from each other. By doing so, it is possible to adjust a balance of nip pressure in an axial direction in a fixing nip. The control unit 17 controls an operation of the pressing/separating unit (not illustrated) to press the back surface-side support member against the fixing surface side member, and thereby the fixing nip is formed which sandwiches and conveys a sheet.

The sheet which has the toner image secondarily transferred thereto and which has been conveyed along a paper passage is heated and pressurized when passing through the fixing unit 23. Consequently, the toner image is fixed to the sheet.

The paper feed unit 14 includes a paper feed tray 141 and a manual paper feed unit 142. The paper feed tray 141 accommodates paper sheets (regular paper, special paper) identified based on a basis weight, a size, and the like, separately for each of predetermined paper types. A plurality of paper feed roller units is disposed in the paper feed tray 141 and the manual paper feed unit 142. It is also possible to connect an external paper feed apparatus (not illustrated) with large capacity to the manual paper feed unit 142. The paper feed unit 14 sends the sheet fed from the paper feed tray 141 or the manual paper feed unit 142 to the paper conveying unit 16

The paper discharge unit 15 includes, for example, a paper discharge roller unit 151, and discharges the sheet sent from the paper conveying unit 16 to outside the apparatus.

The paper conveying unit 16 includes a main conveying unit 161, a switchback conveying unit 162, a conveying unit for back surface printing 163, and a paper passage switching unit (not illustrated). Apart of the paper conveying unit 16 is incorporated into one unit, for example, with the fixing unit 23, and detachably mounted to the image forming apparatus 1.

The main conveying unit 161 includes, as a sheet conveying element which sandwiches and conveys a sheet, a plurality of conveying roller units including a loop roller unit and a registration roller unit. The main conveying unit 161 conveys the sheet fed from the paper feed tray 141 or the manual paper feed unit 142 to pass the sheet through the image forming unit 20 (intermediate transfer unit 22, fixing unit 23), and conveys the sheet sent from the image forming unit 20 (fixing unit 23) toward the paper discharge unit 15 or the switchback conveying unit 162.

The switchback conveying unit 162 temporarily stops the sheet sent from the fixing unit 23, reverses the conveying direction thereof, and conveys the sheet to the paper discharge unit 15 or the conveying unit for back surface printing 163.

The conveying unit for back surface printing 163 conveys the sheet switchbacked by the switchback conveying unit 162 to the main conveying unit 161 in a circulating manner. The sheet is passed through the main conveying unit 161 in a state where back surface thereof is an image forming surface.

The paper passage switching unit (not illustrated) switches the paper passage depending on whether discharging the sheet sent out from the fixing unit 23 as it is, discharging the sheet after it is reversed, or conveying the sheet to the conveying unit for back surface printing 163. Specifically, the control unit 17 controls an operation of the paper passage switching unit (not illustrated) based on a content of the image forming processing (such as one-side/both side printing and face up/face down discharge).

The sheet fed from the paper feed unit 14 is conveyed to the image forming unit 20 by the main conveying unit 161. When the sheet passes through the transfer nip, the toner image on the photoconductor drum 213 is collectively transferred to a first surface (front surface) of the sheet, and fixing processing is performed in the fixing unit 23. The sheet with the image formed thereon is discharged outside the apparatus by the paper discharge unit 15. When images are formed on both surfaces of the sheet, the sheet with the image formed on the first surface thereof is sent to the switchback conveying unit 162, and is reversed by passing through the conveying unit for back surface printing 163 to return to the main conveying unit 161, and then an image is formed on a second surface (back surface) thereof.

In the image forming apparatus 1, a periodic density variation (periodic density unevenness) is caused in a subscanning direction by rotation runout of a rotating member such as the photoconductor drum 213 and the developer holding member 212*a*. The periodic density unevenness varies for each gradation, and for each of colors Y, M, C, and K. Here, description will be given regarding a case where density unevenness is caused by the rotation runout of the developer holding member 212*a* for the K component. However, the same is applied to a case where periodic density unevenness is caused by the rotation runout of other rotating member (for example, the developer holding members 212*a* for Y, M, and C components, respectively, and the photoconductor drums 213 for Y, M, C, and K components, respectively).

In the image forming apparatus 1, the control unit 17 functions as an image information analysis unit 17A, a density profile management unit 17B, a correction data generation unit 17C, and a density correction control unit 17D, so as to prevent periodic density unevenness in the image from occurring. The image processing unit 13 corrects an image forming condition or density value (gradation value) of input image data with the use of correction data generated by the correction data generation unit 17C. In the embodiment, correction data is updated if necessary.

The image information analysis unit 17A analyzes image information (including image object data and text object data) of all pages included in print job data, and acquires image sizes of images, the presence or absence of an image object, and object sizes of image objects, and the like. The "image size" refers to a length of an image in a subscanning direction, which image is printed as one page. The "object size" refers to a length of an individual image object in a subscanning direction, which image object is included in an image on one page.

The density profile management unit 17B manages a density profile indicating density variations in subscanning direction in such a way that a phase of the density profile corresponds to a rotation position of a rotating member (for example, the photoconductor drum 213 or the developer holding member 212*a*) which is a constituent of the image forming unit 20. The density profile is stored, for example, in the storage unit 182.

Figure 3:
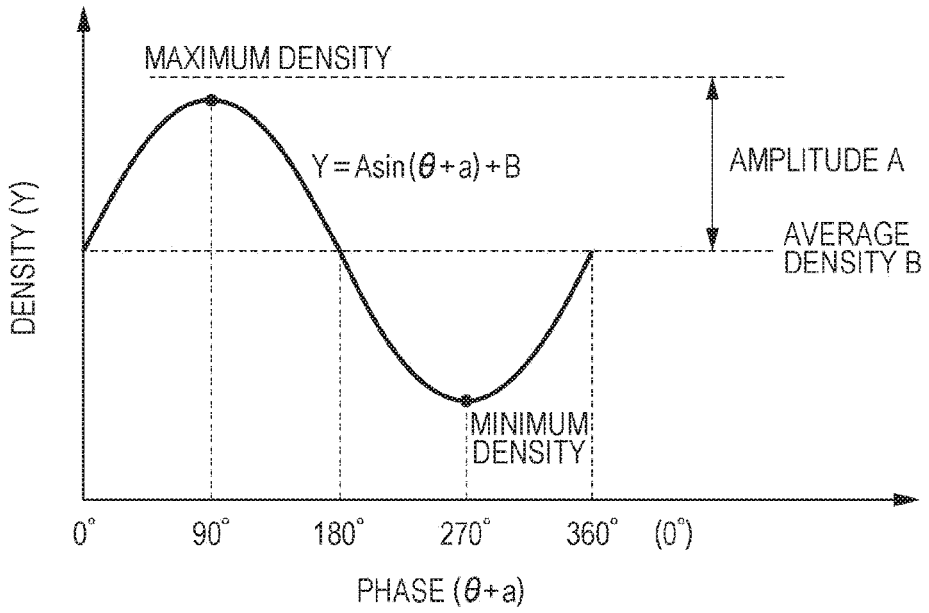
FIG. 3 is a graph illustrating an example of a density profile.

FIG. 3 is a graph illustrating an example of a density profile. As illustrated in FIG. 3, the density profile can be approximated by a sine curve ($Y=A\sin(\theta+\alpha)+B$). Here, A denotes amplitude, $(\theta+\alpha)$ denotes a phase of the density profile, and B denotes an average density. The density profile management unit 17B manages density profiles such as those illustrated in FIG. 3 for each rotating member (for example, for each developer holding member 212*a* or photoconductor drum 213 of each color component).

The density profile management unit 17B manages, as an initial density profile, a density profile generated based on a relationship between runout data specific to a rotating member (for example, variations in a development gap) obtained in a production process and reading sensitivity (density). According to the density profile, the larger the development gap, the lower the density, and the smaller the development gap, the higher the density. In other words, in the density profile illustrated in FIG. 3, a phase at 90° corresponds to a rotation position with the smallest development gap, and a phase at 270° corresponds to a rotation position with the largest development gap.

The density profile management unit 17B forms a density-corrective patch image on the intermediate transfer belt 221 when it is necessary to update correction data, and generates a new density profile based on a detection result of the image density detecting unit 226 regarding the corrective patch image. The corrective patch image is, for example, a halftone image with halftone density, and is formed such that a length in a subscanning direction thereof is adjusted to be substantially the same as the period length of a target rotating member.

The correction data generation unit 17C generates correction data corresponding to a rotation position of a rotating member based on the density profile so as to cancel the periodic density unevenness. The correction data is stored, for example, in the storage unit 182. When the periodic density unevenness is noticeable in the image, the correction data is updated.

The density correction control unit 17D determines a density correction level based on information of an image to be formed. Specifically, the more noticeable the periodic density unevenness in the image, the higher the density correction level is set by the density correction control unit 17D. In accordance with the set density correction level, one among a plurality of types of density correction is selected and performed.

In the image forming apparatus 1, when the density correction level is set at high accuracy, a new density profile is generated based on the image density of the corrective patch image. Density correction with high accuracy is performed using correction data generated based on the new density profile. On the other hand, when the density correction level is set at reference accuracy, correction data is not updated. Density correction with reference accuracy is performed using existing correction data. The existing correction data means correction data which has been stored when starting a print job. In the initial state, the existing correction data means correction data generated based on runout data specific to a rotating member. Specifically, density correction is performed in accordance with a flowchart illustrated in FIG. 4.

Figure 4:
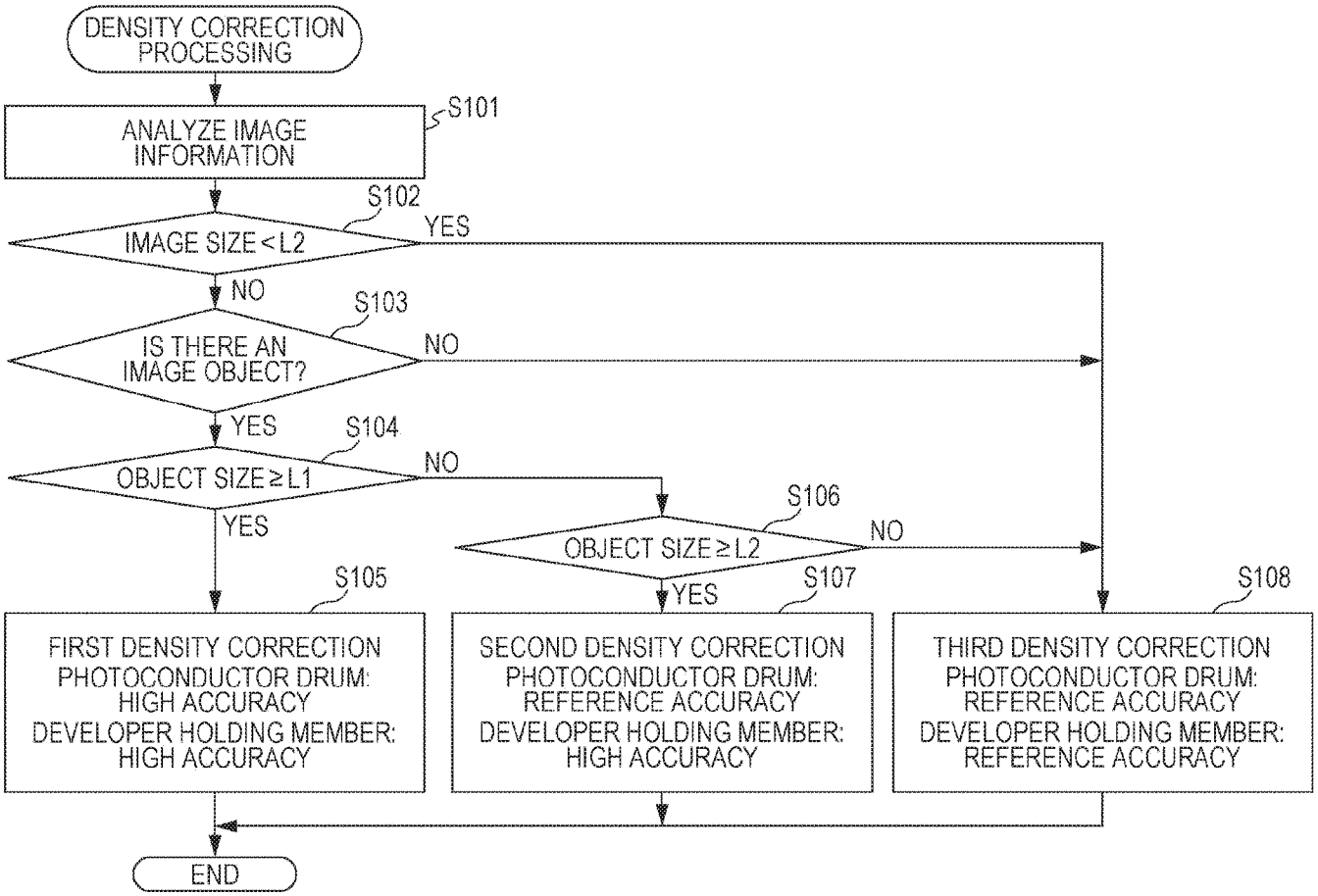
FIG. 4 is a flowchart illustrating an example of density correction processing.

FIG. 4 is the flowchart illustrating an example of density correction processing. This processing is achieved, for example, as follows: the image forming apparatus 1 receives print job data, and in response thereto, the CPU 171 executes a predetermined program stored in the ROM 172. A period length L1 of the photoconductor drum 213 is set to be about three times as large as a period length L2 of the developer holding member 212*a*.

In step S101, the control unit 17 analyzes image information of all pages included in the print job data, and acquires image sizes of images, the presence or absence of an image object, and object sizes of image objects, and the like (processing performed by the control unit 17 as the image information analysis unit 17A).

In step S102, the control unit 17 determines whether the image sizes of all images are shorter than the period length L2 of the developer holding member 212*a* (processing performed by the control unit 17 as the density correction control unit 17D). When the image sizes of all images are shorter than the period length L2 of the developer holding member 212*a* ("YES" in step S102), the processing is moved to step S108. When an image size of at least one image is greater than or equal to the period length L2 of the developer holding member 212*a* ("NO" in step S102), the processing is moved to step S103.

In step S103, the control unit 17 determines whether there is an image including an image object (processing performed by the control unit 17 as the density correction control unit 17D). When there is an image including an image object ("YES" in step S103), the processing is moved to step S104. When there is no image including an image object ("NO" in step S103), in other words, all images include only a text object, the processing is moved to step S108.

In step S104, the control unit 17 determines whether an object size of at least one image object is greater than or equal to the period length L1 of the photoconductor drum 213 (processing performed by the control unit 17 as the density correction control unit 17D). When the object size of at least one image object is greater than or equal to the period length L1 of the photoconductor drum 213 ("YES" in step S104), the processing is moved to step S105. When object sizes of all image objects are shorter than the period length L1 of the photoconductor drum 213 ("NO" in step S104), the processing is moved to step S106.

In step S105, the control unit 17 sets, at high accuracy, the density correction level of the periodic density unevenness caused by the photoconductor drum 213 and that of the periodic density unevenness caused by the developer holding member 212*a* (processing performed by the control unit 17 as the density correction control unit 17D). In the image processing unit 13, a first density correction is performed based on the set density correction level.

When the object size of at least one image object is greater than or equal to the period length L1 of the photoconductor drum 213, periodic density unevenness caused by the photoconductor drum 213 and the developer holding member 212*a* is likely to appear in the image. Therefore, the control unit 17 generates new density profiles using a corrective patch image having a length substantially the same as the period length L1 of the photoconductor drum 213, which new density profiles include a density profile indicating periodic density unevenness caused by the photoconductor drum 213, and a density profile indicating periodic density unevenness caused by the developer holding member 212*a* (processing performed by the control unit 17 as the density profile management unit 17B). Based on the generated density profiles, each correction data is updated (processing performed by the control unit 17 as the correction data generation unit 17C).

In other words, density correction with high accuracy is performed with the updated correction data for each of the periodic density unevenness caused by the photoconductor drum 213, and the periodic density unevenness caused by the developer holding member 212*a*. Consequently, in comparison to a density difference without density correction (maximum density−minimum density in FIG. 3) as a reference, the density difference can be reduced to ½ or smaller.

In step S106, the control unit 17 determines whether an object size of at least one image object is greater than or equal to the period length L2 of the developer holding member 212*a* (processing performed by the control unit 17 as the density correction control unit 17D). When the object size of at least one image object is greater than or equal to the period length L2 of the developer holding member 212*a* ("YES" in step S106), the processing is moved to step S107. When object sizes of all image objects are shorter than the period length L2 of the developer holding member 212*a* ("NO" in step S106), the processing is moved to step S108.

In step S107, the control unit 17 sets, at reference accuracy, the density correction level of the periodic density unevenness caused by the photoconductor drum 213, and sets, at high accuracy, the density correction level of the periodic density unevenness caused by the developer holding member 212*a* (processing performed by the control unit 17 as the density correction control unit 17D). In the image processing unit 13, a second density correction is performed based on the set density correction level.

When the object size of at least one image object is greater than or equal to the period length L2 of the developer holding member 212*a* and smaller than the period length L1 of the photoconductor drum 213, periodic density unevenness caused by the photoconductor drum 213 is unlikely to appear in the image, but periodic density unevenness caused by the developer holding member 212*a* is likely to appear in the image. Therefore the control unit 17 generates a new density profile using a corrective patch image having a length substantially the same as the period length L2 of the developer holding member 212*a*, which new density profile indicates periodic density unevenness caused by the developer holding member 212*a* (processing performed by the control unit 17 as the density profile management unit 17B). Based on the generated density profile, correction data is updated (processing performed by the control unit 17 as the correction data generation unit 17C).

In other words, density correction with high accuracy is performed with the updated correction data for the periodic density unevenness caused by the developer holding member 212*a*. On the other hand, regarding the periodic density unevenness caused by the photoconductor drum 213, density correction with the reference accuracy is performed with the existing correction data. Also in this case, in comparison to a density difference without density correction as a reference, the density difference can be reduced to ⅔ or smaller.

Since the length of the corrective patch image used in step S107 is shorter than the length of the corrective patch image used in step S105, it is possible to reduce the load on the belt cleaning apparatus 225 upon density correction, and to reduce the consumption of toner required for density correction.

In step S108, the control unit 17 sets, at reference accuracy, the density correction level of the periodic density unevenness caused by the photoconductor drum 213 and that of the periodic density unevenness caused by the developer holding member 212*a* (processing performed by the control unit 17 as density correction control unit 17D). In the image processing unit 13, a third density correction is performed based on the set density correction level.

In a case where the image sizes of all images is shorter than the period length L2 of the developer holding member 212*a*, where all images include only a text object, or where object sizes of all image objects are shorter than the period length L2 of the developer holding member 212*a*, periodic density unevenness caused by the photoconductor drum 213 and the developer holding member 212*a* is unlikely to appear in the image (even if appeared, not noticeable). Therefore, density correction with reference accuracy is performed with the existing correction data for each of the periodic density unevenness caused by the photoconductor drum 213, and the periodic density unevenness caused by the developer holding member 212*a*. Consequently, it is possible to reduce the load on the belt cleaning apparatus 225 upon density correction, and to reduce the consumption of toner required for density correction.

As described above, the image forming apparatus 1 includes the image forming unit 20, rotation position detecting units S1 and S2, the image density detecting unit 226, the image information analysis unit 17A, the density profile management unit 17B, the correction data generation unit 17C, the image processing unit 13 (density correction unit), and the density correction control unit 17D. The image forming unit 20 includes the photoconductor drum 213 and the developer holding member 212*a* (rotating members) as a constituent, and forms an image on a sheet based on print job data. The rotation position detecting units S1 and S2 detect rotation positions of the photoconductor drum 213 and the developer holding member 212*a*. The image density detecting unit 226 detects density of an image formed on the intermediate transfer belt 221 (image holding member) by the image forming unit 20. The image information analysis unit 17A analyzes image information included in the print job data. The density profile management unit 17B manages a density profile indicating density variations in a subscanning direction in such away that a phase of the density profile corresponds to a rotation position of the rotating member. The correction data generation unit 17C generates correction data corresponding to rotation positions of the photoconductor drum 213 and the developer holding member 212*a* based on the density profile. The image processing unit 13 (density correction unit) performs density correction with the correction data. The density correction control unit 17D sets a density correction level based on image information of an image to be formed. When the density correction level is set at reference accuracy, the image processing unit 13 performs density correction using existing correction data. When the density correction level is set at accuracy higher than the reference accuracy, the density profile management unit 17B forms, on the intermediate transfer belt 221, a corrective patch image longer than the period length of the photoconductor drum 213 and the developer holding member 212*a*, and generates a new density profile based on the detection result of the image density detecting unit 226 regarding the corrective patch image. The correction data generation unit 17C updates the correction data based on the new density profile. The image processing unit 13 performs density correction using the updated correction data.

In the image forming apparatus 1, a density profile is generated which reflects current periodic density unevenness, if necessary, for example, when periodic density unevenness may appear noticeably in an image, and correction data is updated based on the new density profile. When periodic density unevenness is not noticeable in an image, existing correction data is used and a corrective patch image is not formed beyond necessity. Therefore, it is possible to efficiently and surely correct current periodic density unevenness. Specifically, it is possible to reduce the load on the belt cleaning apparatus 225 and the consumption of toner upon density correction, and to prevent the productivity from decreasing.

Although the invention made by the present inventor has been specifically described based on the embodiment, the present invention is not limited to the above embodiment and may be modified without departing from the gist thereof.

For example, a density profile may be generated by averaging detection results of the image density detecting unit 226 with a corrective patch image having a length substantially the same as a plurality of period lengths (for example, one period length×10) of a target rotating member. Consequently, it is possible to more surely correct periodic density unevenness. In addition, when density correction at high accuracy is performed, a density correction level may be set to include a plurality of stages in accordance with noticeability of periodic density unevenness, so as to change a length of a corrective patch image in accordance with the density correction level.

For example, even in a case where an image includes only a text object, periodic density unevenness may be noticeable when a printing rate is high. In such a case, density correction at high accuracy may be performed.

Although a halftone image (medium tone) is employed as the corrective patch image in the embodiment, a gradation pattern may be employed as the corrective patch image to deal with a difference in density unevenness for each gradation.

The present invention may be applied also to an image forming apparatus which forms an image on a long sheet of paper such as roll paper, and a black-and-white image forming apparatus. The present invention may be applied also when correcting periodic density unevenness caused by a rotating member (for example, the primary transfer roller 222) other than the photoconductor drum 213 and the developer holding member 212*a*.

Although the present invention has been described and illustrated in detail, it is clearly understood that the same is by way of illustrated and example only and is not to be taken by way of limitation, the scope of the present invention being interpreted by terms of the appended claims. The scope of the present invention includes all modifications within the same meaning and range as those of equivalents of the appended claims.

What is claimed is:

1. An image forming apparatus comprising:

an image forming unit that includes a rotating member as a constituent, and forms an image on a sheet based on print job data;

a rotation position detecting unit that detects a rotation position of the rotating member;

an image density detecting unit that detects density of an image formed on an image holding member by the image forming unit;

an image information analysis unit that analyzes image information included in the print job data;

a density profile management unit that manages an existing density profile indicating density variations in a subscanning direction in such a way that a phase of the density profile corresponds to a rotation position of the rotating member;

a correction data generation unit that generates correction data corresponding to a rotation position of the rotating member based on the existing density profile;

a density correction unit that performs density correction with the correction data; and a density correction control unit that sets a density correction level based on image information analyzed by the image information analysis unit, the density correction level being one of a plurality of reference levels including a first level corresponding to a reference accuracy and at least a second level corresponding to a higher accuracy than the reference accuracy, wherein when the density correction control unit sets the density correction level at the first level corresponding to the reference accuracy, the density correction unit performs density correction using from the print job data, the existing correction data, and when the density correction control unit sets the density correction level at the second level corresponding to the higher accuracy than the reference accuracy, the density profile management unit forms, on the image holding member, a corrective patch image longer than a period length of the rotating member, and generates a new density profile based on a detection result of the image density detecting unit regarding the corrective patch image, the correction data generation unit updates the existing correction data based on the new density profile, and the density correction unit performs density correction using the updated existing correction data.

2. The image forming apparatus according to claim 1, wherein the density correction control unit sets the density correction level at the second level when a length of an image object in the subscanning direction included in the image is longer than the period length of the rotating member.

3. The image forming apparatus according to claim 1, wherein the existing correction data includes correction data generated based on previously acquired a variation of a gap between the rotating member and another rotating member.

4. The image forming apparatus according to claim 1, wherein when the density correction level is set at the second level, the density profile management unit forms the corrective patch image to be longer than a plurality of period lengths of the rotating member, and generates the new density profile by averaging detection results of the image density detecting unit regarding the corrective patch image.

5. The image forming apparatus according to claim 1, wherein the image forming unit includes a plurality of the rotating members, and the density correction unit determines the existing density correction level for each of the rotating members.

6. A non-transitory recording medium storing a computer readable program executable to cause an image forming apparatus to perform the following steps:

forming, using an image forming unit that includes a rotating member as a constituent, an image on a sheet based on print job data;

detecting, using a rotation position detecting unit, a rotation position of the rotating member;

detecting, using an image density detecting unit, density of an image formed on an image holding member by the image forming unit;

analyzing, using an image information analysis unit, image information included in the print job data;

managing, using a density profile management unit, an existing density profile indicating density variations in a subscanning direction in such a way that a phase of the density profile corresponds to a rotation position of the rotating member;

generating, using a correction data generation unit, correction data corresponding to a rotation position of the rotating member based on the existing density profile;

performing, using a density correction unit, density correction with the correction data; and setting, using a density correction control unit, a density correction level based on image information analyzed by the image information analysis unit, the density correction level being one of a plurality of reference levels including a first level corresponding to a reference accuracy and at least a second level corresponding to a higher accuracy than the reference accuracy, when the density correction control unit sets the density correction level at the first level corresponding to the reference accuracy, performing density correction using the existing correction data in the density correction unit; and when the density correction control unit sets the density correction level at the second level corresponding to the higher accuracy than the reference accuracy, forming, on the image holding member, a corrective patch image longer than a period length of the rotating member, and generating a new density profile based on a detection result of the image density detecting unit regarding the corrective patch image in the density profile management unit, updating the existing correction data based on the new density profile in the correction data generation unit, and performing density correction using the updated existing correction data in the density correction unit.

7. The non-transitory recording medium storing a computer readable program according to claim 6, wherein the program further comprises setting, using density correction control unit, the density correction level at the second level when a length of an image object in a subscanning direction included in the image is longer than the period length of the rotating member.

8. The non-transitory recording medium storing a computer readable program according to claim 6, wherein the existing correction data includes correction data generated based on previously acquired variation of a gap between the rotating member and another rotating member.

9. The non-transitory recording medium storing a computer readable program according to claim 6, wherein the program further comprises, when the density correction level is set at high accuracy, forming, using the density profile management unit, the corrective patch image to be longer than a plurality of period lengths of the rotating member, and generating the new density profile by averaging detection results of the image density detecting unit regarding the corrective patch image.

10. The non-transitory recording medium storing a computer readable program according to claim 6, wherein the image forming unit in the image forming apparatus includes a plurality of the rotating members, and the program further comprises determining, using the density correction unit, the density correction level for each of the rotating members.

* * * * *